US006266853B1

(12) United States Patent
Ho

(10) Patent No.: US 6,266,853 B1
(45) Date of Patent: Jul. 31, 2001

(54) NON-ROTATABLE ENCLOSING BUCKLE OF FABRIC ARTICLE

(76) Inventor: Wen-Lung Ho, No. 1, Change Ming Lane, Nan Tun Area, Taichung City (TW)

( * ) Notice: Subject to any disclaimer, the term of this patent is extended or adjusted under 35 U.S.C. 154(b) by 0 days.

(21) Appl. No.: 09/404,592

(22) Filed: Sep. 24, 1999

(51) Int. Cl.[7] ..... A44B 1/12; A44B 1/38

(52) U.S. Cl. ..... 24/92; 24/90.1; 24/105; 24/108; 24/114.05; 24/113 MP

(58) Field of Search ..... 24/105, 104, 103, 24/108, 109, 114.4, 114.05, 114.12, 101 R, 113 R, 113 MP, 92

(56) References Cited

U.S. PATENT DOCUMENTS

| | | | | |
|---|---|---|---|---|
| 230,814 | * | 8/1880 | Porter | 24/109 |
| 1,814,966 | * | 7/1931 | Rosenberg | 24/113 MP |
| 2,863,197 | * | 12/1958 | Statham | 24/114.4 |
| 3,009,381 | * | 11/1961 | Rapata | 24/114.4 |
| 3,643,296 | * | 2/1972 | Kahn | 24/108 |
| 3,644,965 | * | 2/1972 | Kahn | 24/114.05 |
| 4,457,050 | * | 7/1984 | Kanzaka | 24/108 |
| 4,607,415 | * | 8/1986 | Fukuroi | 24/113 R |
| 4,943,197 | * | 7/1990 | Baritz | 24/113 MP |
| 5,513,422 | | 5/1996 | Wen-Lung . | |
| 5,517,730 | | 5/1996 | Ho . | |
| 5,644,820 | | 7/1997 | Ho . | |

* cited by examiner

*Primary Examiner*—Victor N. Sakran
(74) *Attorney, Agent, or Firm*—Dougherty & Troxell

(57) ABSTRACT

A not rotatable enclosing buckle of fabric article, including a female buckle body formed with a shaft hole passing through a bottom end thereof and a male buckle body including a main body and a nail post upward projecting from the main body. The nail post penetrates through the fabric article and inserting into the shaft hole of the female buckle body so as to latch the male and female buckle bodies on the fabric article. A stem of the nail post is formed with at least one rib. The rib and the longitudinal axis of the stem contain an angle other than 90 degrees. The rib defines a maximum outer circumference of the stem, whereby the rib meshes with the peripheral wall of the shaft hole to prevent the male and female buckle bodies from rotating relative to each other.

5 Claims, 5 Drawing Sheets

NON-ROTATABLE ENCLOSING BUCKLE OF FABRIC ARTICLE

BACKGROUND OF THE INVENTION

The present invention relates to an enclosing buckle of fabric article, and more particularly to an enclosing buckle which can be latched on a fabric article without rotation.

FIG. 1 shows a conventional baseball hat or leisure hat. The hat body 10 is made of multiple fabric pieces 12 by stitching. The center of the hat body is latched with an enclosing buckle 14 for covering the seams of the fabric pieces 12 and beautifying the appearance of the hat body.

FIG. 2 shows the structure of a conventional enclosing buckle 20 which includes a buckle body 22 and a buckle seat 24. The buckle body 22 has a post section 26 Penetrating through the hat body 25 to insert into a hole 28 of the buckle seat so as to latch the enclosing buckle on the hat body.

FIGS. 3 and 4 show two other conventional enclosing buckle structures designed by the inventor. In FIG. 3, the enclosing buckle 30 has a female buckle body 32 wrapped by a decorative cloth 34. A fastening member 35 is used to fix the inner periphery of the decorative cloth 34. The enclosing buckle 30 further has a male buckle body 36 having a cylindrical post section 37 which penetrates through the hat body 38 to insert into the hole 33 of the female buckle body, In FIG. 4, the enclosing buckle 40 has a male buckle body 46 having a cylindrical post section 47 which penetrates through the hat body 48 to insert into the hole 43 of the female buckle body 42. A cover body 45 with a decorative cloth 44 covers the female buckle body 42.

The above enclosing buckles 20, 30, 40 all have a common shortcoming. With FIG. 4 exemplified, after the post section 47 of the male buckle body 46 is inserted into the hole 43 of the female buckle body 42, the male and female buckle bodies are latched with each other and locked on the hat body 48 without detachment. However, the post section 47 is cylindrical so that the post section 47 is rotatable within the hole 43. Therefore, the male and female buckle bodies 42, 46 will be rotated relative to each other. As a result, the male and female buckle bodies can be hardly firmly latched on the hat body without loosening.

SUMMARY OF THE INVENTION

It is therefore a primary object of the present invention to provide an enclosing buckle of fabric article in which the male and female buckle bodies can be latched on the fabric article without rotating relative to each other.

It is a further object of the present invention to provide the above enclosing buckle which can be latched on the fabric article without rotation.

The present invention can be best understood through the following description and accompanying drawings wherein:

DETAILED DESCRIPTION OF THE PREFERRED EMBODIMENTS

Figure 1:
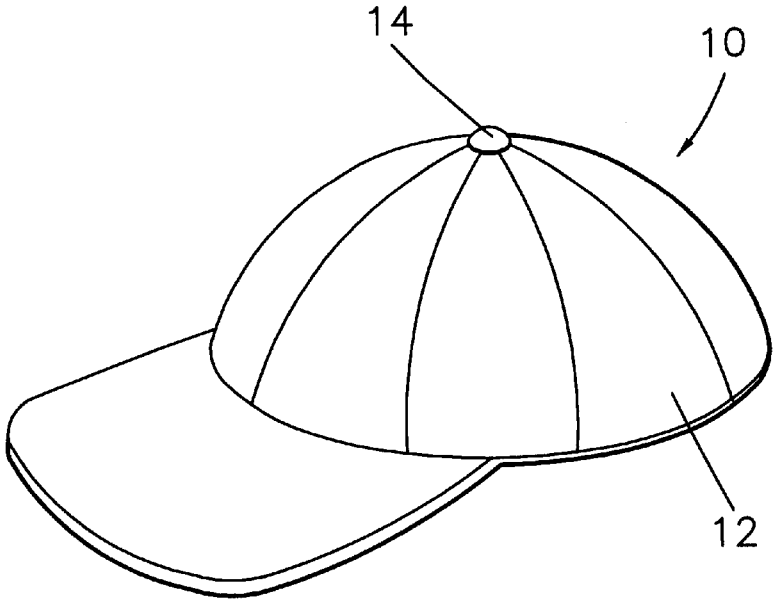
FIG. 1 PRIOR ART
FIG. 1 is a perspective view of a conventional hat on which an enclosing buckle is latched.
Figure 2:
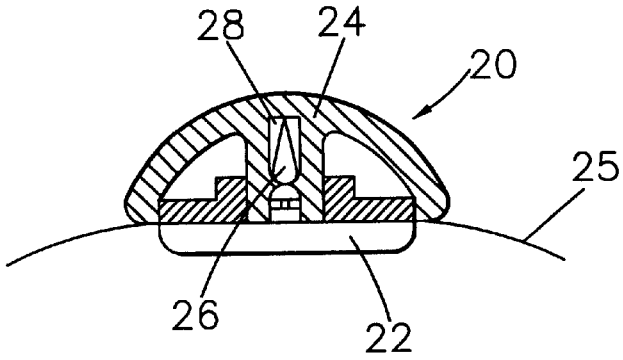
FIG. 2 PRIOR ART
FIG. 2 is a sectional assembled view of a conventional enclosing buckle structure latched on a hat body.
Figure 3:
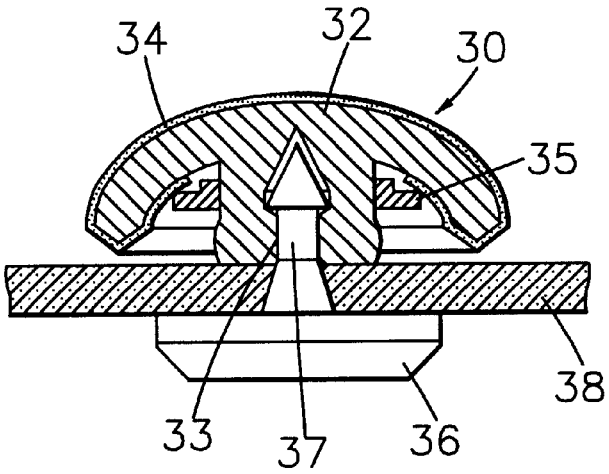
FIG.3 PRIOR ART
FIG. 3 is a sectional assembled view of another conventional enclosing buckle structure latched on a hat body.
Figure 4:
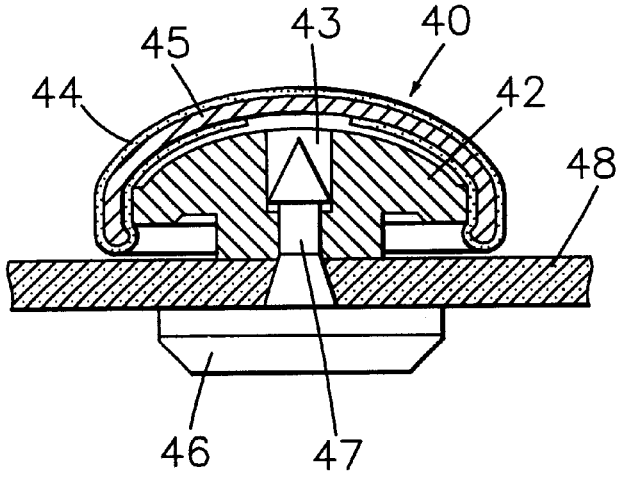
FIG.4 PRIOR ART
FIG. 4 is a sectional assembled view of still another conventional enclosing buckle structure latched on a hat body.
Figure 5:
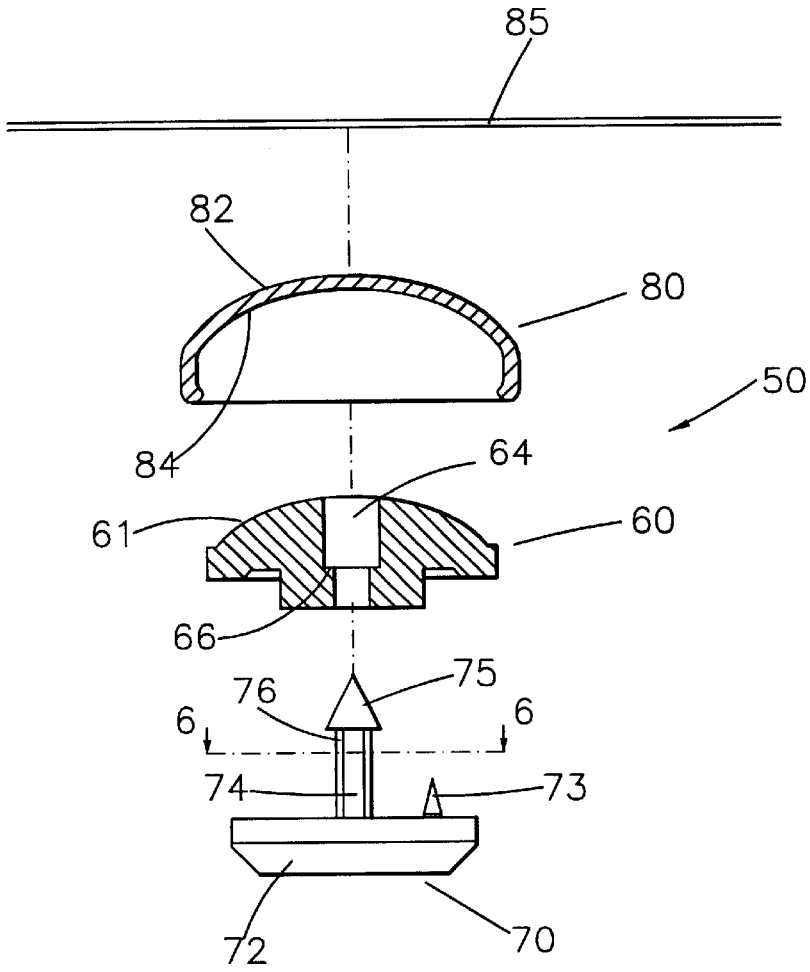
FIG. 5 is a partially sectional exploded view of a first embodiment of the present invention.

Please refer to FIG. 5. According to a first embodiment, the enclosing buckle 50 of the present invention includes a female buckle body 60 and a male buckle body 70. The female buckle body 60 is made of plastic material by injection molding. The female buckle body is formed with a stepped shaft hole 64 having an upper section with larger diameter defining a shoulder section 66.

Figure 6:
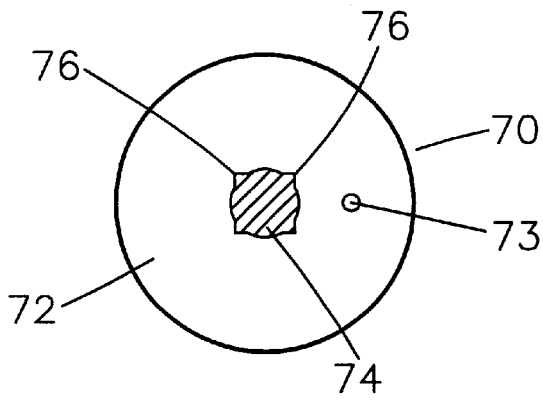
FIG. 6 is a sectional view taken along line 6—6 of FIG. 5.

The male buckle body 70 includes a disc-shaped main body 72 and a nail post 74 and a penetrating post 73 upward projecting from the top face of the main body 72. The top end of the nail post 74 is disposed with a conic head section 75 with larger diameter. The stem of the nail post is formed with several longitudinal ribs 76. In this embodiment, as shown in FIG. 6, the stem of the nail post 74 is cylindrical and the ribs 76 are formed on the circumference of the stem at predetermined intervals. The ribs project from the stem to define a maximum outer circumference. The outer edge of each rib is sharp. The penetrating post 73 has a sharp top end.

The enclosing buckle 50 further includes a fastening member having a bowl-like cover body 80. The cover body 80 has a top convex face 82 and a bottom concave face 84.

Figure 7:
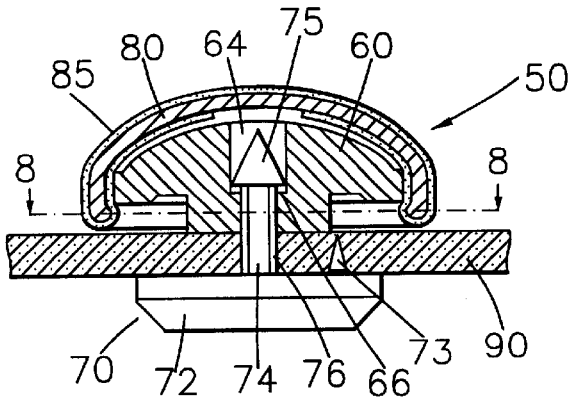
FIG. 7 is a sectional assembled view according to FIG. 5.

The enclosing buckle 50 further includes a decorative cloth 85 wrapping the convex face 82 of the cover body 80. Referring to FIG. 7, the end of the decorative cloth 85 is folded into the concave face 84 of the cover body. The cover body 80 together with the decorative cloth 85 covers the top arch face 61 of the female buckle body 60 with the decorative cloth wrapping the periphery of the female buckle body.

When assembled, the cover body 80 with the decorative cloth 85 wraps the outer periphery of the female buckle body 60. The nail post 74 of the male buckle body 70 penetrates the hat body 90 from lower side thereof and upward inserts into the shaft hole 64 of the female buckle body. The bottom edge of the head section 75 of the nail post is engaged with the shoulder section 66. As shown in FIG. 7, the male and female buckle bodies are mated and latched with each other without detachment. Therefore, the enclosing buckle is locked on the hat body 90 with the penetrating post 73 penetrating into the hat body.

Figure 8:
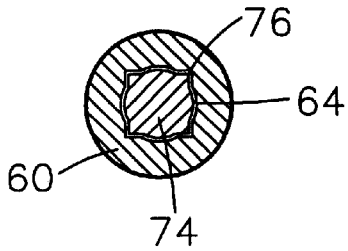
FIG. 8 is a sectional view taken along line 8—8 of FIG. 7, showing that the nail post is engaged with the inner wall of the shaft hole.

The nail post 74 is inserted into the shaft hole 64 to latch the male and female buckle bodies 60, 70 with each other. Thereafter, the ribs 76 around the stem of the nail post are forced into the peripheral wall of the shaft hole as shown in FIG. 8. Therefore, the inner wall of the shaft hole is pressed and deformed by the ribs to achieve a meshing effect between the ribs 76 and the shaft hole 64. Accordingly, the male and female buckle bodies are engaged with each other without relative rotation. The penetrating post 73 penetrates into the hat body to prevent the enclosing buckle from rotating relative to the hat body.

Figure 9:
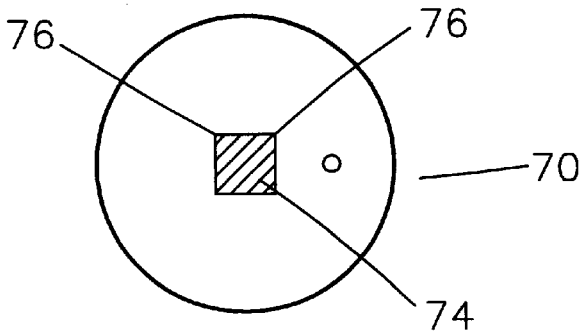
FIG. 9 is a sectional view showing another embodiment of the nail post of the male buckle body of the present invention.

FIG. 9 shows another preferred embodiment of the present invention, in which except the nail post 74 of the male buckle body 70, all the parts of this embodiment are identical to those of the above embodiment. The nail post 74 has a rectangular cross-section. The four corners of the nail post 74 are longitudinal ribs 76 formed on the stem of the nail post. The ribs 76 define a maximum outer circumference of the stem for meshing with the shaft hole.

In practice, the cross-section of the stem of the nail post 74 can alternatively have a triangular or pentagonal or other polygonal shape.

Figure 10:
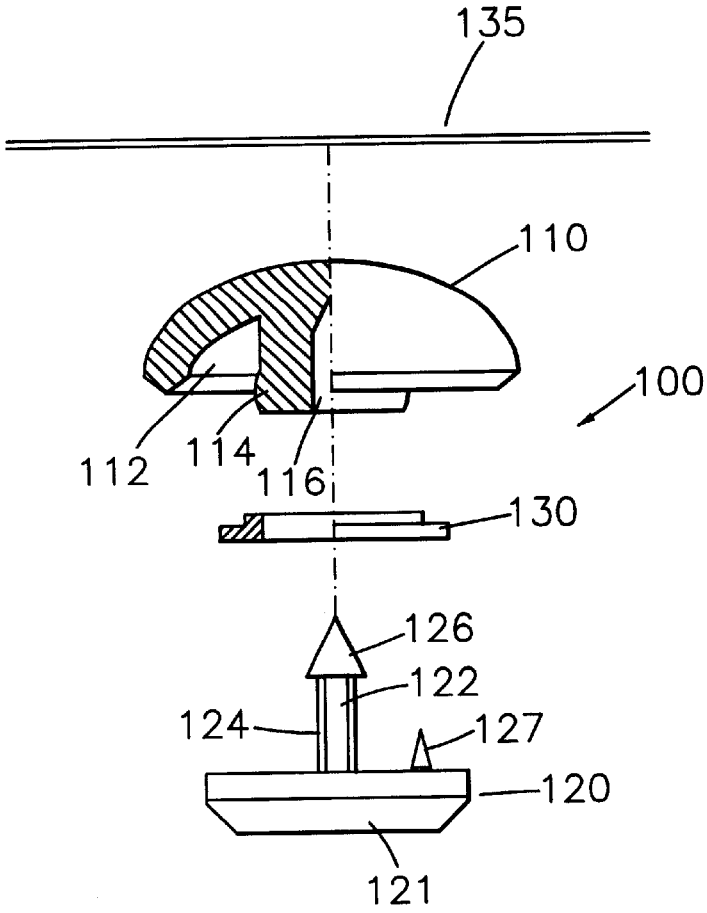
FIG. 10 is a partially sectional exploded view of still another embodiment of the present invention.
Figure 11:
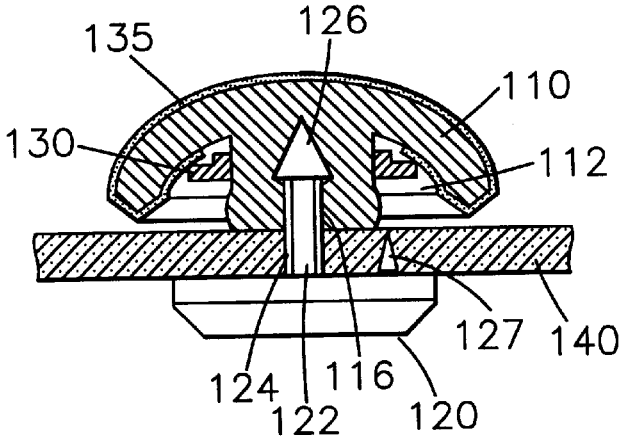
FIG. 11 is a sectional assembled view according to FIG. 10.

FIGS. 10 and 11 show still another preferred embodiment of the enclosing buckle 100 of the present invention, in which the bottom of the female buckle body 110 is formed with an inward extending recess 112. A projecting post 114 downward extends from the recess 112. The projecting post 114 is formed with a shaft hole 116 with unified diameter.

The nail post 122 of the male buckle body 120 is formed with several ribs 124. After the nail post 122 penetrates the hat body 140 to be inserted and located in the shaft hole 116, the inner wall of the shaft hole 116 is expanded and deformed by the head section 126 of the nail post 122. Therefore, the bottom edge of the head section 126 is engaged in the shaft hole to prevent the nail post from detaching from the projecting post.

The fastening member 130 is a ring body fitted around the projecting post 114. After the decorative cloth 135 wraps the outer periphery of the female buckle body 110, the fastening member 130 binds the periphery of the decorative cloth 135 in the recess 112.

After the male and female buckle bodies are mated and latched with each other, the ribs 124 of the nail post 122 will mesh with the inner wall of the shaft hole 116 to prevent the male and female buckle bodies 110, 120 from rotating relative to each other. Also, the penetrating post 127 of the male buckle body 121 penetrates into the hat body 140.

According to the above arrangement, after the male and female buckle bodies are latched with each other, they cannot be rotated relative to each other. Therefore, the enclosing buckle can be firmly locked without loosening or detaching from an article. Furthermore, the penetrating post of the male buckle body penetrates into the hat body so as to prevent the enclosing buckle from rotating relative to the hat body.

In practice, the angle contained by the ribs and the longitudinal axis of the nail post can be a predetermined angle other than 90 degrees. The predetermined angle enables the nail post to mesh with the inner wall of the shaft hole without rotation. In addition, the shaft hole of the female buckle body is not limited to the above two embodiments as shown in the drawings. For example, the shaft hole 64 of the first embodiment is not necessary to pass through the top section of the female buckle body and it is not necessary to form the shoulder section 66 in the shaft hole 64. Similarly, the shaft hole 116 of the second embodiment can pass through the top section of the female buckle body or be formed with a shoulder section.

The above embodiments are only used to illustrate the present invention, not intended to limit the scope thereof. Many modifications of the above embodiments can be made without departing from the spirit of the present invention.

What is claimed is:

1. A non-rotatable buckle for attachment to a fabric article and comprising:

a) a female buckle body having a shaft hole bounded by an inner wall and adapted to be located on a first side of the fabric article;

b) a male buckle including a disc-shaped main body with a nail post and a penetrating post extending therefrom, the nail post having a conical head section and a plurality of outwardly extending longitudinal ribs, each rib having a sharp outer edge, the male buckle adapted to be located on a second side of the fabric article such that the nail post extends through the fabric article and into the shaft hole of the female buckle body, the sharp outer edges of the longitudinal ribs deforming the inner wall to thereby prevent relative rotation between the female buckle body and the male buckle, the penetrating post engaging the fabric of the fabric article so as to prevent relative rotation between the male buckle and the fabric article.

2. The non-rotatable buckle as claimed in claim 1, further comprising a fabric cloth wrapping located on an outer surface of the female buckle body.

3. The non-rotatable buckle as claimed in claim 2, further comprising a fastening member disposed between the female buckle body and the fabric cloth wrapping for keeping the fabric cloth wrapper on the female buckle body.

4. The non-rotatable buckle as claimed in claim 3, wherein the fastening member comprises a bowl-like cover body having a convex face and a concave face, the fabric cloth wrapping located on the convex face of the cover body, an end of the fabric cloth wrapping being folded into the concave face of the cover body.

5. The non-rotatable buckle as claimed in claim 4, wherein the bottom of the female buckle body has an inward extending recess, and further comprising a projecting post extending from the recess, the projecting post having the shaft hole therein, the fabric cloth wrapping located on an outer surface of the female buckle body, an end of the fabric cloth being folded into the recess, the fastening member comprising a ring body fitted around the projecting post and binding the fabric cloth in the recess.

* * * * *